US007500729B2

(12) United States Patent
Sakaida

(10) Patent No.: US 7,500,729 B2
(45) Date of Patent: Mar. 10, 2009

(54) METHOD FOR CORRECTING AN AMOUNT OF EJECTED INK IN LINE HEAD INKJET PRINTER

(75) Inventor: Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 530 days.

(21) Appl. No.: 11/197,324

(22) Filed: Aug. 5, 2005

(65) Prior Publication Data

US 2006/0050101 A1 Mar. 9, 2006

(30) Foreign Application Priority Data

Aug. 5, 2004 (JP) ..... 2004-229736
Aug. 5, 2004 (JP) ..... 2004-229737
Aug. 5, 2004 (JP) ..... 2004-229738

(51) Int. Cl.
*B41J 29/38* (2006.01)
*B41J 29/393* (2006.01)

(52) U.S. Cl. ..... 347/14; 347/6; 347/19

(58) Field of Classification Search ..... 347/19
See application file for complete search history.

(56) References Cited

U.S. PATENT DOCUMENTS

| | | | | |
|---|---|---|---|---|
| 5,596,353 | A | 1/1997 | Takada et al. | |
| 6,042,213 | A | 3/2000 | Hayasaki et al. | |
| 6,094,280 | A | 7/2000 | Hayasaki et al. | |
| 6,779,871 | B1 * | 8/2004 | Seto et al. | 347/40 |
| 6,832,825 | B1 | 12/2004 | Nishigori et al. | |
| 7,093,918 | B2 * | 8/2006 | Askeland et al. | 347/19 |
| 7,249,815 | B2 * | 7/2007 | Keller et al. | 347/19 |
| 2001/0026294 | A1 | 10/2001 | Takahashi | |
| 2002/0054311 | A1 | 5/2002 | Kubo | |
| 2003/0048331 | A1 | 3/2003 | Takahashi et al. | |
| 2004/0085384 | A1 | 5/2004 | Ju et al. | |
| 2005/0116974 | A1 | 6/2005 | Suzuki | |
| 2006/0028500 | A1 | 2/2006 | Sakaida | |
| 2006/0028507 | A1 | 2/2006 | Sakaida | |

FOREIGN PATENT DOCUMENTS

| | | |
|---|---|---|
| EP | 0 625 425 | 5/1994 |
| EP | 0 709 192 | 5/1996 |

(Continued)

OTHER PUBLICATIONS

Machine Translation of JP 2004-177262 to Shirasaki, generated on Jun. 3, 2008.*

(Continued)

*Primary Examiner*—Luu Matthew
*Assistant Examiner*—Shelby Fidler
(74) *Attorney, Agent, or Firm*—Banner & Witcoff, Ltd.

(57) ABSTRACT

A method for correcting an amount of ejected ink in a line head inkjet printer, includes measuring an amount of ink ejected from each block including at least one nozzle, nozzles formed in an inkjet head, the nozzles divided into the blocks; and obtaining a correction factor for each block on a basis of the measured amount of ejected ink in each block. The correction factors make a difference among the blocks in that an amount of ejected ink per nozzle becomes small.

9 Claims, 10 Drawing Sheets

FOREIGN PATENT DOCUMENTS

| | | |
|---|---|---|
| EP | 1 403 047 | 3/2004 |
| EP | 1 535 746 | 6/2005 |
| JP | 3-213345 | 9/1991 |
| JP | 2001-105697 | 4/2001 |
| JP | 2004177262 A * | 6/2004 |

OTHER PUBLICATIONS

First Office Action in the corresponding Chinese Patent Application No. 200510089374.6, dated Mar. 30, 2007.

* cited by examiner

METHOD FOR CORRECTING AN AMOUNT OF EJECTED INK IN LINE HEAD INKJET PRINTER

BACKGROUND OF THE INVENTION

1. Field of the Invention

The invention relates to a method for correcting an amount of ejected ink in a line head inkjet printer.

2. Description of the Related Art

An inkjet head includes a large number of nozzles for ejecting ink, and ink flow paths connected to the nozzles, respectively. The ink flow paths include pressure chambers for generating pressure to eject ink. By ejecting ink from nozzles to a print medium, a desired image is formed on the print medium. In such an inkjet head, an amount of ink ejected from the nozzles may vary in accordance with variation in accuracy in production of the nozzles and the ink flow paths, variation in shape of the ink flow paths, variation in characteristic of actuators for generating pressure in the pressure chambers, and so on. There has been proposed a technique in which: the ink ejection surface is divided into blocks each having a plurality of nozzles; a printing result formed on a print medium when ink drops are ejected from nozzles onto the print medium is detected for each block by an optical sensor; and the amount of ink ejected from the nozzles is corrected for each block, on the basis of a result of the detection (see U.S. Pat. No. 6,832,825).

SUMMARY OF THE INVENTION

According to U.S. Pat. No. 6,832,825, because the amount of ejected ink from the nozzles is corrected for each block, variation in the amount of ejected ink between the nozzles can be suppressed so easily that density irregularity in a result of printing can be reduced. It is however impossible to detect the shape of a dot accurately by the optical sensor if the surface state of the print medium varies. In this case, the amount of ink ejected from the nozzles cannot be corrected accurately, so that density irregularity in a result of printing can be hardly suppressed.

Also, the variation in the amount of ejected ink causes density irregularity in a result of printing. Particularly in an inkjet head of a line head inkjet printer in which an image is formed on a print medium by a single pass, variation in the amount of ejected ink tends to increase because an ink ejection surface elongates in one direction.

The invention provides a method for correcting an amount of ejected ink in a line head inkjet printer in which density irregularity in a result of printing can be suppressed surely.

A method according to one aspect of the invention corrects an amount of ejected ink in a line head inkjet printer. The method includes: measuring an amount of ink ejected from each block including at least one nozzle, a plurality of nozzles formed in an inkjet head, the plurality of nozzles divided into the blocks; and obtaining a correction factor for each block on a basis of the measured amount of ejected ink in each block. The correction factors make a difference among the blocks in an amount of ejected ink per nozzle become small.

If printing result is detected as set forth in U.S. Pat. No. 6,832,825, printing error due to variation in a surface state of a printing medium may occur. To the contrary, according to this method, because the amount of ejected ink is actually measured for each of the blocks, such an error due to the variation in a surface state of a print medium does not occur. Accordingly, correction factors can be calculated so accurately that density irregularity in a result of printing can be suppressed surely. Because the device for actually measuring the amount of ejected ink is simpler than any optical sensor, correction factors for the amount of ejected ink can be calculated at low cost. Accordingly, the cost of production of the line head inkjet printer can be reduced.

DETAILED DESCRIPTION OF THE EMBODIMENTS

A first embodiment of the invention will be described below with reference to the drawings.

Figure 1:
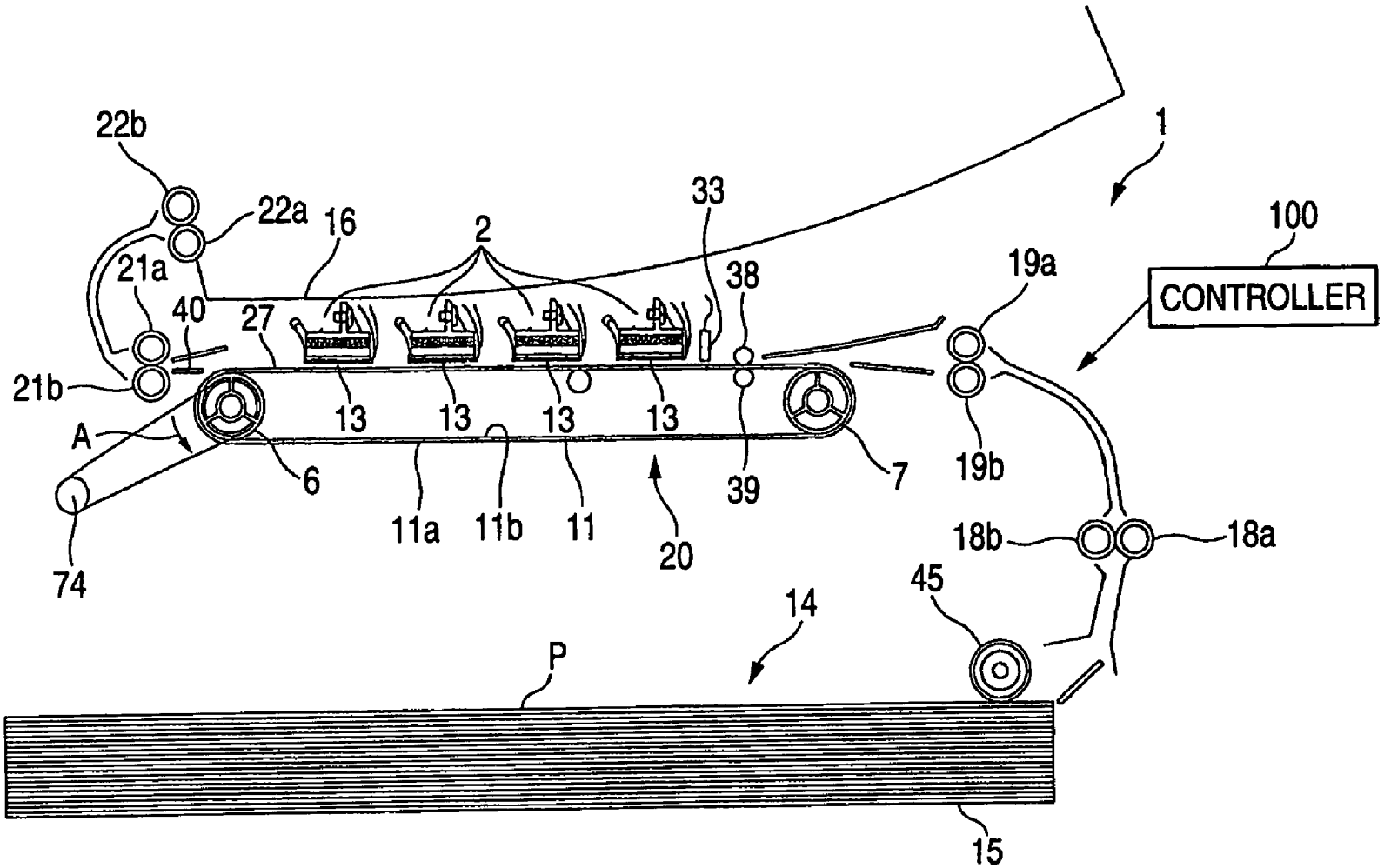
FIG. 1 is a schematic configuration view of a printer to which a method for correcting an amount of ejected ink according to a first embodiment of the invention is applied.

Referring first to FIG. 1, a printer to which a method for correcting an amount of ejected ink according to the first embodiment of the invention will be described. The printer 1 shown in FIG. 1 is a line head color inkjet printer having four fixed inkjet heads 2 each shaped like a narrow rectangle elongating in a direction perpendicular to the paper showing FIG. 1 in plan view. In FIG. 1, the printer 1 has a paper feeding unit 14 provided in its lower portion, a paper receiving portion 16 provided in its upper portion, and a conveyance unit 20 provided in its middle portion. The printer 1 further has a controller 100 (see FIG. 6) for controlling the operations of the printer 1.

The paper feeding unit 14 has a paper storage section 15, and a paper feed roller 45. Rectangular sheets of print paper P stacked on one another can be stored in the paper storage section 15. The paper feed roller 45 feeds the sheets of print paper P one by one toward the conveyance unit 20 in such a manner that the uppermost one of the sheets of print paper P in the paper storage section 15 is fed toward the conveyance unit 20. The sheets of print paper P are stored in the paper storage section 15 so that the sheets of paper P can be fed in a direction parallel to long sides of each sheet of paper P. Two pairs of feed rollers 18A, 18B, 19A and 19B are disposed along a conveyance path between the paper storage section 15 and the conveyance unit 20. A sheet of print paper P fed out of the paper feeding unit 14 is conveyed upward in FIG. 1 by the feed rollers 18A and 18B with one short side of the sheet of print paper P as a front end and then conveyed leftward to the conveyance unit 20 by the feed rollers 19A and 19B.

A rotation shaft of the paper feed roller 45 inclines by 3° relative to a direction perpendicular to an inner wall (not shown) of the paper storage section 15 so that the rotation shaft becomes closer to the conveyance unit 20 as it becomes farther from the inner wall. For this reason, the sheet of print paper P picked up by the paper feed roller 45 advances in a direction slightly inclined from the inner wall of the paper storage section 15 so that one long side of the sheet of print paper P is forced to approach the inner wall of the paper storage section 15. The inner wall of the paper storage section 15 is parallel to the conveyance direction of the sheet of print paper P by the conveyance unit 20. Before one short side of the sheet of print paper P reaches the feed rollers 18A and 18B, one long side of the sheet of print paper P abuts on the inner wall of the paper storage section 15. Then, the sheet of print paper P goes toward the feed rollers 18A and 18B along the inner wall of the paper storage section 15 while one long side of the sheet of print paper P abuts on the inner wall of the paper storage section 15. By such a simple configuration that the paper feed roller 45 is inclined relative to the inner wall of the paper storage section 15, skewing of the sheet of print paper P can be corrected while continuous feeding of the sheet of print paper P can be ensured. The sheet of print paper P clamped by the feed rollers 18A and 18B is fed out toward the conveyance unit 20 via feed rollers 19A and 19B.

The conveyance unit 20 has an endless conveyance belt 11, and two belt rollers 6 and 7 wound with the conveyance belt 11. The length of the conveyance belt 11 is adjusted so that predetermined tension is generated in the conveyance belt 11 wound between the two belt rollers 6 and 7. By winding the conveyance belt 11 between the two belt rollers 6 and 7, two planes, which include common tangents to the belt rollers 6 and 7, respectively and are parallel to each other, are formed on the conveyance belt 11. One of the two planes, which faces the inkjet heads 2, serves as a conveyance surface 27 for the sheet of print paper P. The sheet of print paper P fed out of the paper feeding unit 14 is conveyed on the conveyance surface 27 of the conveyance belt 11 while printing is performed on an upper surface of the sheet of print paper P by the inkjet heads 2. Thereafter, the sheet of print paper P reaches the paper receiving portion 16. In the paper receiving portion 16, sheets of print paper P on which printing has been already performed are stacked on one another.

Each of the four inkjet heads 2 has a head body 13 at its lower end. As will be described later, the head body 13 has a flow path unit 4 (see FIG. 4), and actuator units 21 bonded onto the flow path unit 4. A large number of individual ink flow paths 32 including pressure chambers 10 communicating with nozzles 8 are formed in the flow path unit 4. The actuator units 21 can give pressure to ink in desired ones of the pressure chambers 10.

Each head body 13 is shaped like a rectangular parallelepiped, which is narrow and elongates in a direction perpendicular to the paper showing FIG. 1 in plan view. The four head bodies 13 are disposed closely to one another along the left-right direction in the paper showing FIG. 1. A large number of nozzles 8 (see FIG. 2) with a very small diameter are defined in each of bottom surfaces (ink ejection regions) of the four head bodies 13. The color of ink ejected from each nozzle 8 is any one of magenta (M), yellow (Y), cyan (C) and black (K). The colors of ink ejected from the large number of nozzles 8 belonging to one head body 13 are the same. Different types of ink with colors selected from the four colors of magenta, yellow, cyan and black are ejected from the large numbers of ink discharge ports belonging to the four head bodies 13, respectively.

A slight gap is formed between the bottom surface of each head body 13 and the conveyance surface 27 of the conveyance belt 11. The sheet of print paper P is conveyed from right to left in FIG. 1 along a conveyance path, which passes through the gap. When the sheet of print paper P passes through below the four head bodies 13 successively, ink is ejected from the nozzles 8 toward the upper surface of the sheet of print paper P in accordance with image data to thereby form a desired color image on the sheet of print paper P.

An outer circumferential surface 11A of the conveyance belt 11 is treated with silicone rubber having adhesiveness. Accordingly, when one belt roller 6 rotates counterclockwise (in the direction of the arrow A in FIG. 1), the conveyance unit 20 can convey the sheet of print paper P fed by the feed rollers 18A, 18B, 19A and 19B toward the paper receiving portion 16 while the sheet of print paper P is held on the outer circumferential surface 11A of the conveyance belt 11 by the adhesiveness of the outer circumferential surface 11A.

The two belt rollers 6 and 7 are in contact with an inner circumferential surface 11B of the conveyance belt 11. Of the two belt rollers 6 and 7 of the conveyance unit 20, the belt roller 6 located on the downstream side of the conveyance path is connected to a conveyance motor 74. The conveyance motor 74 is driven to rotate on the basis of control of the controller 100. The other belt roller 7 is a driven roller, which is rotated by rotation force given from the conveyance belt 11 with the rotation of the belt roller 6.

The nip rollers 38 and 39 are disposed near the belt roller 7 so that the conveyance belt 11 is clamped between the nip rollers 38 and 39. Each of the nip rollers 38 and 39 has a pipe body, which has a length substantially equal to the axial length of the belt roller 7 and is rotatable freely. The nip roller 38 is urged downward by a spring not shown so that the sheet of print paper P fed to the conveyance unit 20 can be pressed against the conveyance surface 27. Because the nip rollers 38 and 39 cooperate with the conveyance belt 11 to nip the sheet of print paper P, the sheet of print paper P is surely adhered to the conveyance surface 27.

A release plate 40 is provided on a left side of the conveyance unit 20 in FIG. 1. A right end of the release plate 40 enters in between the sheet of print paper P and the conveyance belt 11 so that the sheet of print paper P adhered to the conveyance surface 27 of the conveyance belt 11 is released from the conveyance surface 27.

Two pairs of feed rollers 21A, 21B, 22A and 22B are disposed between the conveyance unit 20 and the paper receiving portion 16. The sheet of print paper P discharged from the conveyance unit 20 is conveyed upward in FIG. 1 by the feed rollers 21A and 21B and fed to the paper receiving portion 16 by the feed rollers 22A and 22B while one short side of the sheet of print paper P serve as a leading edge.

As shown in FIG. 1, a paper surface sensor 33, which is an optical sensor including a light-emitting element and a light-receiving element, is disposed between the nip roller 38 and the inkjet head 2 located on the most upstream side. The paper surface sensor 33 is configured so that the light-emitting element emits light toward a detection position on the conveyance path, and that the light-receiving element receives reflected light. The level of a signal output from the paper surface sensor 33 represents difference in intensity of the reflected light in accordance with the presence/absence of the sheet of print paper P at the detection position. That is, the leading edge of the sheet of print paper P reaches the detection position at a point of time when the level of the output signal increases rapidly. Because the arrival of the leading edge of the sheet of print paper P in the detection position can be found on the basis of the output signal of the paper surface sensor 33, a print signal is supplied to the inkjet heads 2 in accordance with the point of time.

Figure 2:
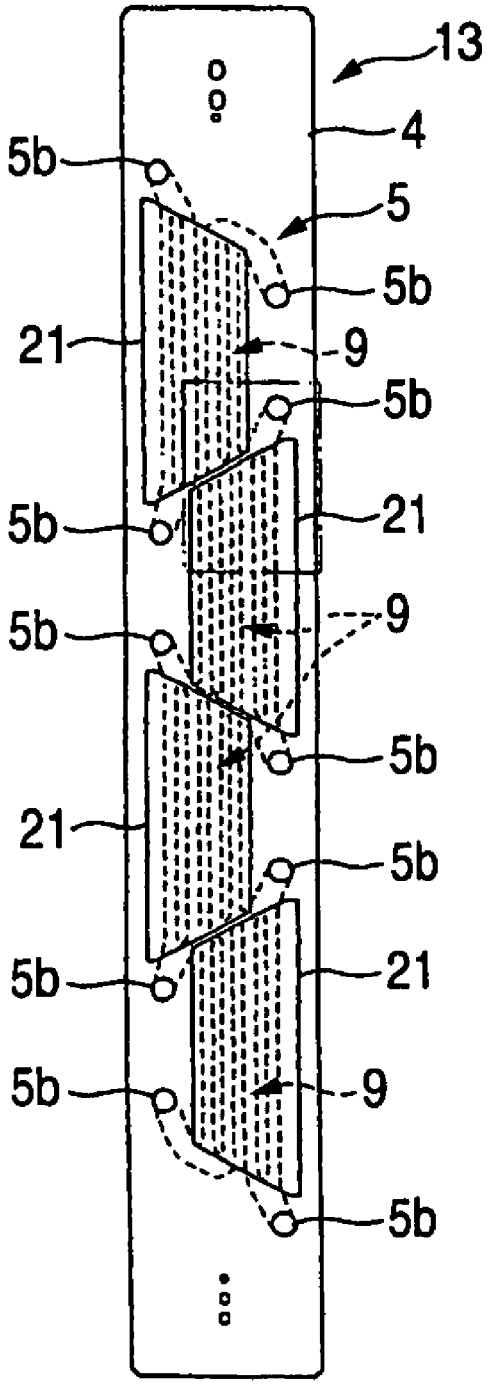
FIG. 2 is a plan view of one of head bodies depicted in FIG. 1.
Figure 3:
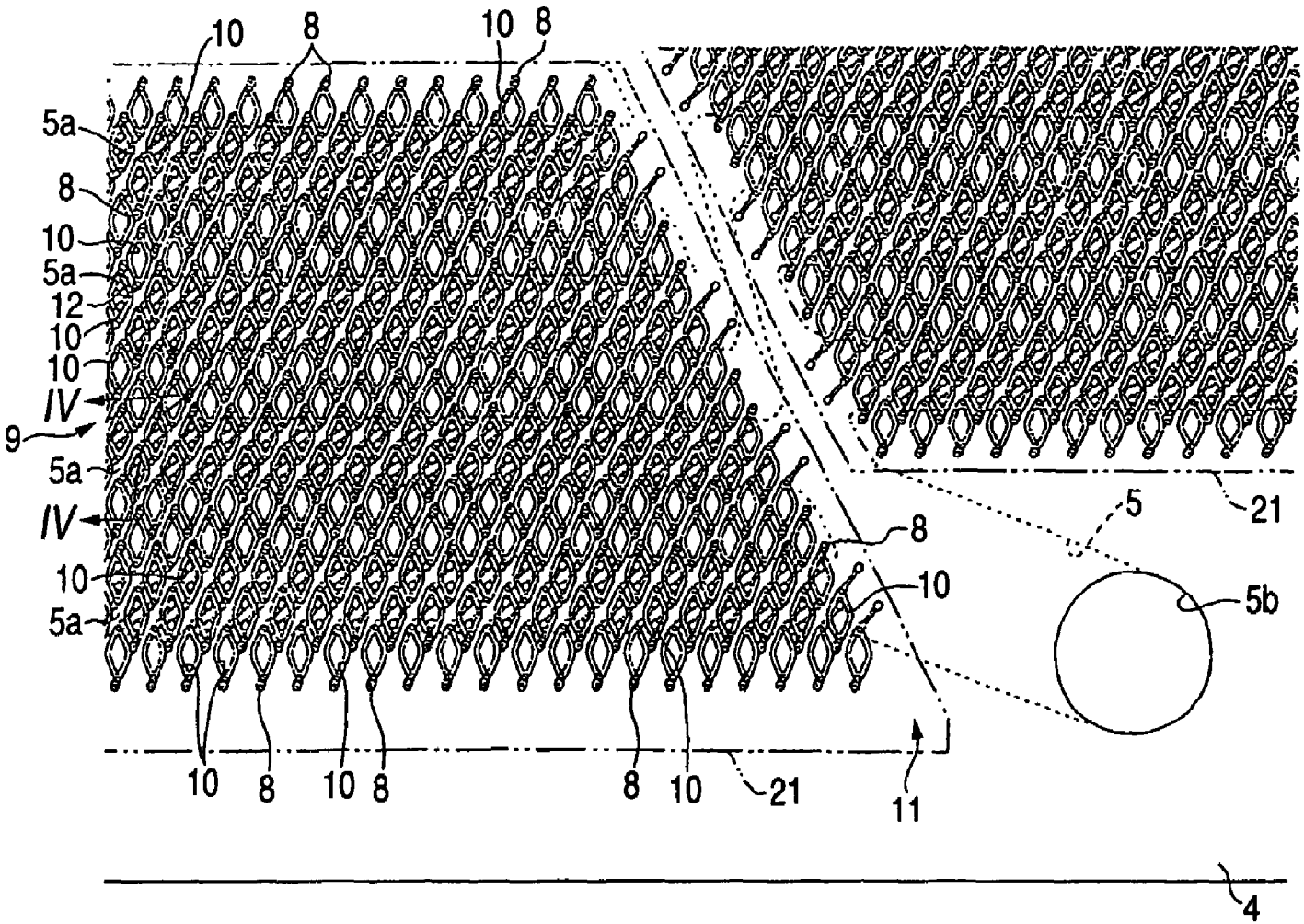
FIG. 3 is an enlarged view of a region surrounded by the one-dot chain line depicted in FIG. 2.

Referring to FIGS. 2 and 3 next, each head body 13 will be described in detail. FIG. 2 is a plan view of one of the head bodies 13 depicted in FIG. 1. FIG. 3 is an enlarged plan view of a region surrounded by the one-dot chain line in FIG. 2. As shown in FIGS. 2 and 3, the head body 13 has a flow path unit 4 in which a large number of pressure chambers 10 making up pressure chamber groups 9 and a large number of nozzles 8 are formed. Trapezoidal actuator units 21 arranged zigzag on two rows are bonded to an upper surface of the flow path unit 4. More specifically, each actuator unit 21 is provided so that parallel opposite sides (upper and lower sides) of the actuator unit 21 are arranged along the lengthwise direction of the flow path unit 4. Oblique sides of adjacent actuator units 21 overlap one another in the widthwise direction of the flow path unit 4.

A lower surface of the flow path unit 4 positionally corresponding to bonding regions of the actuator units 21 serves as an ink ejection region. As shown in FIG. 3, a large number of nozzles 8 are arranged in the form of a matrix in a surface of the ink ejection region. Pressure chambers 10 communicating with respective nozzles 8 are arranged in the form of a matrix. A plurality of pressure chambers 10 located in the lower surface of the flow path unit 4 positionally corresponding to the bonding region of one actuator unit 21 form one pressure chamber group 9.

Each nozzle 8 is a tapered nozzle and communicates with a sub-manifold 5A through a pressure chamber 10 having a rhomboid shape in plan view and an aperture 12. The sub-manifolds 5A serve as a flow path, which braches from a manifold 5. The manifold 5 has opening portions 5B, which are provided in the upper surface of the flow path unit 4 and connected to an ink outflow path not shown. Ink is supplied to the flow path unit 4 from an ink tank not shown through the ink outflow path. Incidentally, the pressure chambers 10 (pressure chamber groups 9), the opening portions 5B and the apertures 12, which should be drawn as broken lines because they are below each actuator unit 21, are drawn as solid lines in FIGS. 2 and 3 in order to make it easy to understand the drawings.

Figure 4:
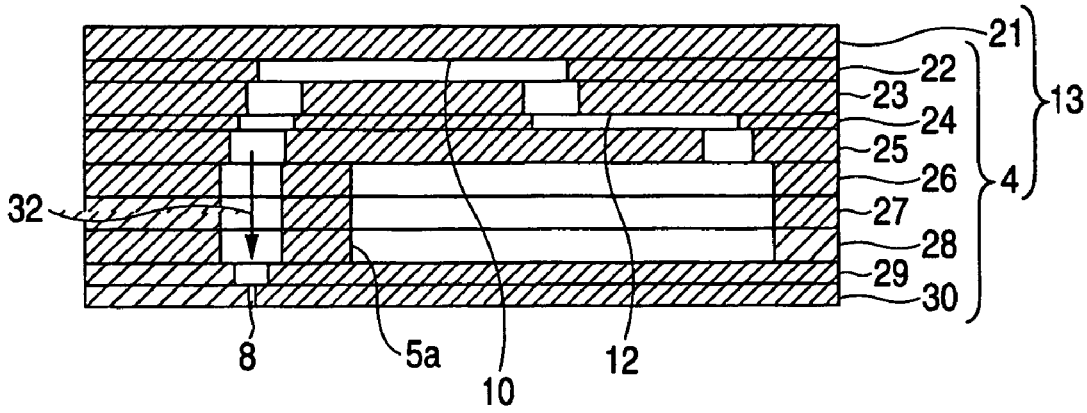
FIG. 4 is a sectional view taken along the line IV-IV in FIG. 3.

Referring to FIG. 4 next, a sectional structure of each head body 13 will be described in detail. FIG. 4 is a sectional view taken along the line IV-IV in FIG. 3. As shown in FIG. 4, the head body 13 is a product in which a flow path unit 4 and actuator units 21 are bonded to each other (see FIG. 2). The flow path unit 4 has a laminate structure in which a cavity plate 22, a base plate 23, an aperture plate 24, a supply plate 25, manifold plates 26, 27 and 28, a cover plate 29 and a nozzle plate 30 are laminated in descending order.

The cavity plate 22 is a metal plate having a large number of nearly rhomboid holes formed as the pressure chambers 10. The base plate 23 is a metal plate, which has a large number of connection holes each for connecting one pressure chamber 10 to a corresponding aperture 12, and a large number of connection holes each for connecting the pressure chamber 10 to a corresponding nozzle 8. The aperture plate 24 is a metal plate, which has a large number of holes formed as the apertures 12, and a large number of connection holes each for connecting one pressure chamber 10 to a corresponding nozzle 8. The supply plate 25 is a metal plate, which has a large number of connection holes each for connecting an aperture 12 to a corresponding sub-manifold 5A, and a large number of connection holes each for connecting the pressure chamber 10 to a corresponding nozzle 8. The manifold plates 26, 27 and 28 are metal plates which have holes formed as the sub-manifolds 5A, and a large number of connection holes each for connecting one pressure chamber 10 to a corresponding nozzle 8. The cover plate 29 is a metal plate, which has a large number of connection holes each for connecting one pressure chamber 10 to a corresponding nozzle 8. The nozzle plate 30 is a metal plate, which has a large number of nozzles 8 formed therein. The nine plates 22 to 30 are laminated while aligned with one another so that individual ink flow paths 32 are formed.

Figure 5A:
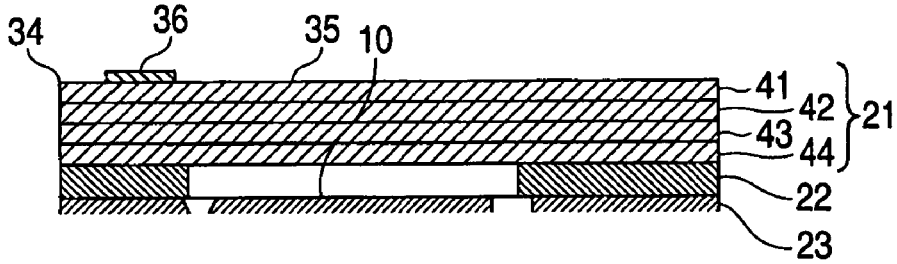
FIGS. 5A and 5B are enlarged views of one of actuator units depicted in FIG. 2.
Figure 5B:
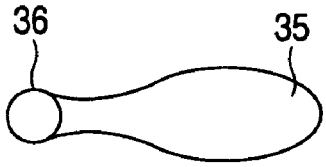

Next, the configuration of each actuator unit 21 will be described with reference to FIGS. 5A and 5B. FIG. 5A is a partial enlarged sectional view showing the actuator unit 21 and a pressure chamber 10. FIG. 5B is a plan view showing the shape of an individual electrode formed on the actuator unit 21.

As shown in FIG. 5A, the actuator unit 21 has a laminate structure in which four piezoelectric sheets 41, 42, 43 and 44 are laminated. The piezoelectric sheets 41 to 44 are formed to have an equal thickness of about 15 μm. The piezoelectric sheets 41 to 44 are continuous flat plates (continuous flat plate layers), which are arranged over a large number of pressure chambers 10 formed in one ink ejection region. Each of the piezoelectric sheets 41 to 44 is made of a lead zirconate titanate (PZT)-based ceramic material having ferroelectricity.

An individual electrode 35 positionally corresponding to each pressure chamber 10 is formed on the piezoelectric sheet 41, which is the uppermost layer. A common electrode 34 of about 2 μm thick is interposed between the piezoelectric sheet 41 as the uppermost layer and the piezoelectric sheet 42 on the downside of the uppermost layer so that the common electrode 34 is formed on the whole surfaces of the sheets. Incidentally, there is no electrode disposed between the piezoelectric sheet 42 and the piezoelectric sheet 43. Each of the individual electrode 35 and the common electrode 34 is made of a metal material such as AG-PD.

As shown in FIG. 5B, the individual electrode 35 has about 1 μm in thickness and has a rhomboid planar shape substantially similar to the shape of the pressure chamber 10 shown in FIG. 3. One of acute angle portions of the rhomboid individual electrode 35 is extended. A circular land portion 36 having a diameter of about 160 μm and electrically connected to the individual electrode 35 is provided at an extended end of the rhomboid individual electrode 35. For example, the land portion 36 is made of gold containing glass frit. As shown in FIG. 5A, the land portion 36 is bonded onto a surface of the extended portion of the individual electrode 35.

The common electrode 34 is grounded in a region not shown. Accordingly, the common electrode 34 is kept at ground potential equally in regions corresponding to all the pressure chambers 10. The individual electrodes 35 are electrically connected to a driver IC not shown but provided as a part of the controller 100 individually so that electric potential can be selectively controlled for each pressure chamber 10.

Next, a method for driving the actuator unit 21 will be described. A polarization direction of the piezoelectric sheet 41 in the actuator unit 21 is a thickness direction of the piezoelectric sheet 41. That is, the actuator unit 21 has a so-called unimorph type structure in which one piezoelectric sheet 41 on the upside (i.e., far from the pressure chambers 10) is used as a layer including an active portion while three piezoelectric sheets 42 to 44 on the downside (i.e., near to the pressure chambers 10) are used as non-active portions. Accordingly, when the electric potential of an individual electrode 35 is set at a predetermined positive or negative value, an electric field applied portion of the piezoelectric sheet 41 put between electrodes serves as an active portion and shrinks in a direction perpendicular to the polarization direction by the transverse piezoelectric effect if the direction of the electric field is the same as the polarization direction. On the other hand, the piezoelectric sheets 42 to 44 are not affected by the electric field, so that the piezoelectric sheets 42 to 44 do not shrink spontaneously. Accordingly, a difference in distortion in the direction perpendicular to the polarization direction is generated between the piezoelectric sheet 41 on the upside and the piezoelectric sheets 42 to 44 on the downside, so that the whole of the piezoelectric sheets 41 to 44 is deformed so as to be curved convexly on the non-active side (unimorph deformation). On this occasion, as shown in FIG. 5A, the lower surface of the piezoelectric sheets 41 to 44 is fixed to the upper surface of the cavity plate 22, which defines the pressure chambers. As a result, the piezoelectric sheets 41 to 44 are deformed so as to be curved convexly toward the pressure chamber side. In this case, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

The actual driving procedure is as follows. That is, the electric potential of each individual electrode 35 is set to be higher (hereinafter referred to as high potential) than that of the common electrode 34 in advance. Whenever an ejection request is made, the electric potential of the individual electrode 35 is once changed to the same electric potential (hereinafter referred to as low potential) as that of the common electrode 34 and then changed to the high potential again at predetermined timing. Accordingly, the piezoelectric sheets 41 to 44 are restored to the original shape at the timing of turning the electric potential of the individual electrode 35 to the low potential, so that the volume of the pressure chamber 10 increases compared with the initial state (in which the two electrodes are different in electric potential from each other). In this case, negative pressure is applied to the inside of the pressure chamber 10 so that ink is sucked into the pressure chamber 10 from the manifold 5 side. Then, the piezoelectric sheets 41 to 44 are deformed so as to be curved convexly toward the pressure chamber 10 side at the timing when the electric potential of the individual electrode 35 is turned to the high potential again. As a result, the volume of the pressure chamber 10 is reduced to turn the pressure of the inside of the pressure chamber 10 to a positive value to increase the pressure of ink to thereby eject an ink drop. That is, a pulse based on high electric potential is supplied to the individual electrode 35 to eject the ink drop. It is ideal that the width of the pulse is equal to AL (Acoustic Length), which is a length of time when pressure wave propagates from the manifold 5 to the nozzle 8 in the pressure chamber 10. According to this procedure, when the inside of the pressure chamber 10 is inverted from a negative pressure state to a positive pressure state, both pressures are joined into one strong pressure by which the ink drop can be ejected.

As for gradation printing, gradation expression is realized by number of ink droplets ejected from a nozzle 8, that is, an amount (volume) of ink adjusted on the basis of number of times, which ink drops are ejected from a nozzle 8. Therefore, ink ejections of the number of times corresponding to the designated gradation expression are performed continuously from the nozzle 8 corresponding to the designated dot region. Generally, when ink ejections are performed continuously, it is preferable that the distance between pulses supplied to eject ink drops is equal to AL. In this manner, the period of residual pressure wave of the pressure generated when an ink drop was ejected previously coincides with the period of pressure wave of the pressure generated when an ink drop is ejected afterwards, so that the pressure waves can be superposed on each other to increase the pressure for ejecting the ink drops.

Figure 6:
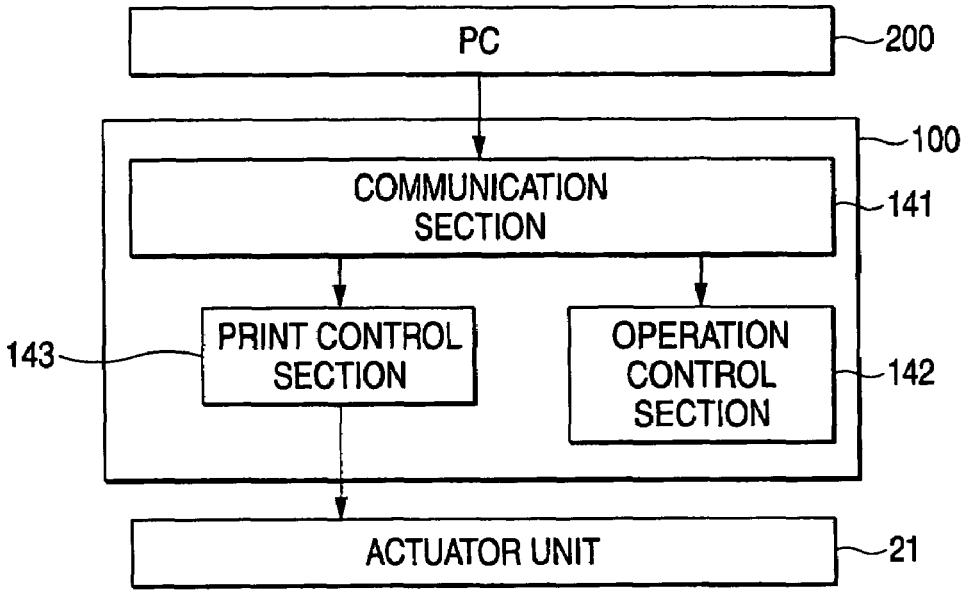
FIG. 6 is a functional block diagram of a controller depicted in FIG. 1.

Next, the controller 100 will be described in detail with reference to FIG. 6. FIG. 6 is a functional block diagram of the controller 100. The controller 100 includes: a CPU (Central Processing Unit) serving as a processor; an ROM (Read Only Memory) for storing programs executed by the CPU and data used in the programs; an RAM (Random Access Memory) for temporarily storing data at the time of execution of the programs; and a driver IC for driving the actuator units 21. These components work so cooperatively that functional sections described below can work.

The controller 100 operates on the basis of an instruction given from a personal computer (PC) 200. As shown in FIG. 6, the controller 100 functionally includes a communication section 141, an operation control section 142, and a print control section 143. Incidentally, each of the functional sections is implemented by hardware such as an ASIC (Application Specific Integrated Circuit). All of the functional sections may be implemented by software or part of the functional sections may be implemented by software.

The communication section 141 communicates with the PC 200. The communication section 141 outputs an instruction relating to operation transmitted from the PC 200, to the operation control section 142. The communication section 141 outputs an instruction relating to printing transmitted from the PC 200, to the print control section 143. The operation control section 142 controls the conveyance motor 74, etc. on the basis of the instruction given from the PC 200 and an instruction given from the print control section 143. The print control section 143 executes printing on the basis of the instruction relating to printing, which is given from the PC 200.

Figure 7:
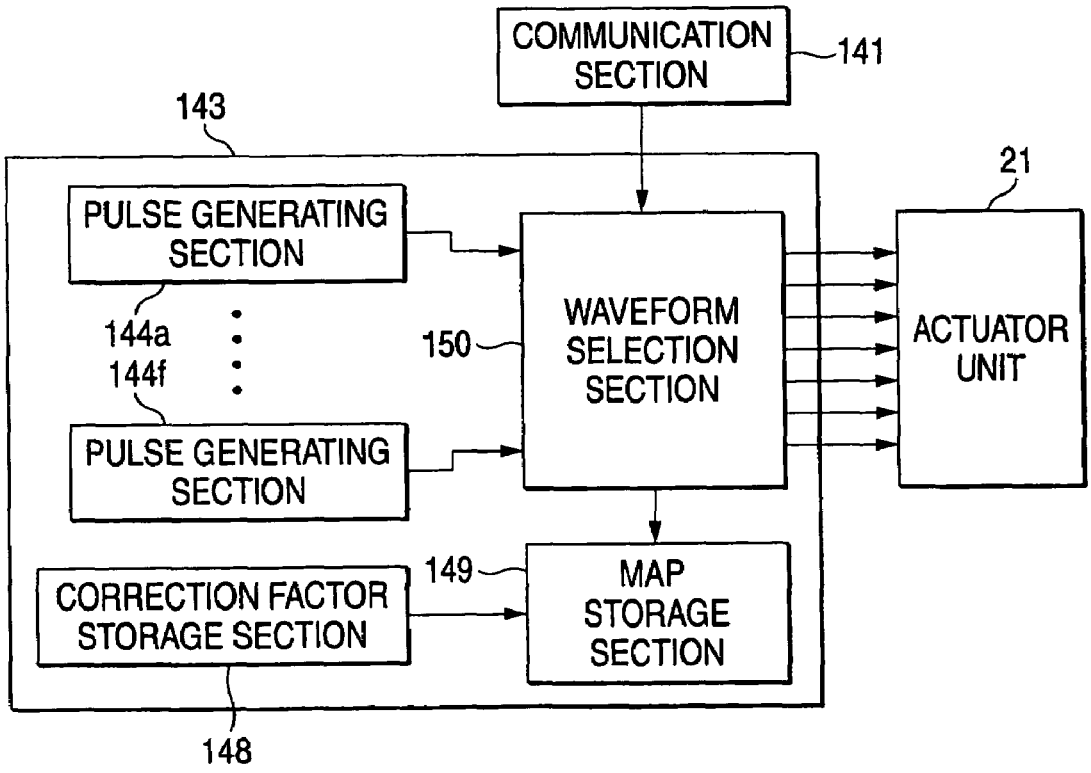
FIG. 7 is a functional block diagram of a print control section depicted in FIG. 6.

Next, the print control section 143 will be described in detail with reference to FIG. 7. FIG. 7 is a functional block diagram of the print control section 143. As shown in FIG. 7, the print control section 143 has six pulse generating sections 144*a* to 144*f*, a correction factor storage section 148, a map storage section 149, and a waveform selection section 150.

The pulse generating sections 144*a* to 144*f* generate pulses with six waveform patterns different from one another. In this embodiment, gradation printing can be performed with three gradation levels (not inclusive of the case of non-ejecting). Gradation printing can be achieved in such a manner that small, middle and large ink drops different in volume from one another are ejected. The gradation levels in gradation printing will be hereinafter expressed as small drop, middle drop and large drop. As for the six waveform patterns, two kinds of patterns are provided for each gradation level. Also, three-bit codes (001 to 110) are added to the six waveform patterns in order to specify the waveform patterns, respectively. Table 1 shows an example of the six waveform patterns.

TABLE 1

| Waveform pattern | Code |
|---|---|
| Small drop 1 | 001 |
| Small drop 2 | 010 |
| Middle drop 1 | 011 |
| Middle drop 2 | 100 |
| Large drop 1 | 101 |
| Large drop 2 | 110 |

As shown in Table 1, the waveform patterns 001 and 010 are both provided for forming small drops. The waveform patterns 001 and 010 are generated so that the amount of ejected ink in use of the waveform pattern 010 is larger than the amount of ejected ink in use of the waveform pattern 001. The waveform patterns 011 and 100 are both provided for forming middle drops. The waveform patterns 011 and 100 are generated so that the amount of ejected ink in use of the waveform pattern 100 is larger than the amount of ejected ink in use of the waveform pattern 011. The waveform patterns 101 and 110 are both provided for forming large drops. The waveform patterns 101 and 110 are generated so that the amount of ejected ink in use of the waveform pattern 110 is larger than the amount of ejected ink in use of the waveform pattern 101. Incidentally, the amount of ejected ink for forming small drop is smaller than the amount of ejected ink for forming middle drop and that for forming large drop. Also, the amount of ejected ink for forming middle drop is smaller than the amount of ejected ink for forming large drop.

The pulse generating section 144*a* generates pulses with the waveform pattern 001. The pulse generating section 144*b* generates pulses with the waveform pattern 010. The pulse generating section 144*c* generates pulses with the waveform pattern 011. The pulse generating section 144*d* generates pulses with the waveform pattern 100. The pulse generating section 144*e* generates pulses with the waveform pattern 101. The pulse generating section 144*f* generates pulses with the waveform pattern 110.

The correction factor storage section 148 stores, as correction factor table, correction factors set for each gradation level in each block, which is defined to contain at least one nozzle 8 in an ink ejection region of the head body 13. Each correction factor is provided for ranking each block on the basis of the amount of ejected ink per nozzle 8 in each block. Each correction factor is determined on the basis of the ratio of the amount of ejected ink per nozzle 8 in each block to an ideal amount of ejected ink from one nozzle 8. As will be described later, the correction factor is determined in a step of correcting an amount of ejected ink in a process of production of the head body 13. Alternatively, the correction factor may be determined in such a manner that the amount of ejected ink is measured for each block by a sensor provided in the printer 1. Because the amount of ink ejected from nozzles 8 in each block is corrected on the basis of the correction factor, difference among the blocks in the amount of ejected ink per nozzle 8 can be made small. Specifically, if the controller 100 controls ink ejection with using the correction factors, the difference among the blocks in the amount of ejected ink per nozzle 8 is smaller than that without using the correction factors.

Figure 8:
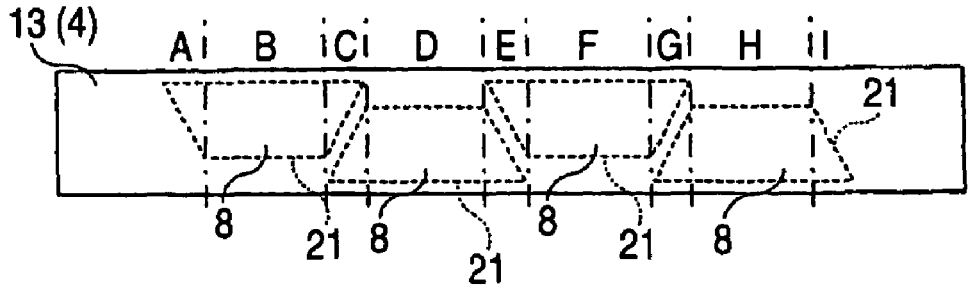
FIG. 8 is a plan view showing an ink ejection region in one of the head bodies depicted in FIG. 1.

FIG. 8 shows an example of block setting. FIG. 8 is a plan view showing an ink ejection region in the head body 13. A region positionally corresponding to each actuator unit 21 is represented by the broken line. These regions define the respective pressure chamber groups 9 and are shaped like a trapezoid. A large number of nozzles 8 are formed in the respective regions defining the pressure chamber groups 9 (see FIGS. 2 and 3). As shown in FIG. 8, the ink ejection region is divided into nine blocks A to I by eight virtual lines extending in the conveyance direction of the sheet of print paper P. Each virtual line passes through a vertex connecting an oblique side of the trapezoid defining the pressure chamber group 9 with a short side of the trapezoid. That is, the virtual lines are set so that the virtual lines pass through structural change points of the head body 13 extending in a direction perpendicular to the conveyance direction. In other words, at least one of blocks (blocks C, E, and G in FIG. 8) includes a whole boundary area between two adjacent actuator units 21. In FIG. 8, the boundary area between the two adjacent actuator units 21 is a parallelogram area defined by oblique sides of the two adjacent actuator units 21. Table 2 shows an example of the correction factor table corresponding to the blocks A to I depicted in FIG. 8.

TABLE 2

| Block | Correction factor (for small drop) | Correction factor (for middle drop) | Correction factor (for large drop) |
|---|---|---|---|
| A | 0 | 0 | 0 |
| B | 0 | 0 | 0 |
| C | 0 | 0 | 1 |
| D | 0 | 1 | 1 |
| E | 1 | 1 | 1 |
| F | 0 | 1 | 1 |
| G | 0 | 0 | 1 |
| H | 0 | 0 | 0 |
| I | 0 | 0 | 0 |

As shown in Table 2, the blocks in the ink ejection region of the head body 13 are ranked by two correction factors "0" and "1" for each gradation level. The correction factor "0" indicates that the amount of ejected ink per nozzle 8 is standard. The correction factor "1" indicates that the amount of ejected ink per nozzle 8 is smaller than the standard. Incidentally, the correction factors may be set by an arbitrary number of ranks.

The map storage section 149 is provided so that a combination of waveform patterns to minimize the difference among blocks in the amount of ejected ink per nozzle 8 in gradation printing is stored as a selection map, which is determined for respective blocks and for each gradation level on the basis of the correction factor table stored in the correction factor storage section 148. Table 3 shows an example of the selection map.

TABLE 3

| Block | Waveform pattern (for small drop) | Waveform pattern (for middle drop) | Waveform pattern (for large drop) |
|---|---|---|---|
| A | 001 | 011 | 101 |
| B | 001 | 011 | 101 |
| C | 001 | 011 | 110 |
| D | 001 | 100 | 110 |
| E | 010 | 100 | 110 |
| F | 001 | 100 | 110 |
| G | 001 | 011 | 110 |
| H | 001 | 011 | 101 |
| I | 001 | 011 | 101 |

As shown in Table 3, in blocks A to D and blocks F to I in which the correction factor for small drop gradation is set to "0" in the correction factor table stored in the correction factor storage section 148, the waveform pattern used for forming small drop gradation is set to the waveform pattern "001" indicating standard in the amount of ejected ink. On the other hand, in a block E in which the correction factor for small drop gradation is set to "1", the waveform pattern used for forming small drop gradation is set to the waveform pattern "010", which is larger in the amount of ejected ink than the waveform pattern "001". In blocks A to C and blocks G to I in which the correction factor for middle drop gradation is set to "0" in the correction factor table, the waveform pattern used for forming middle drop gradation is set to the waveform pattern "011" which is standard in the amount of ejected ink. On the other hand, in blocks D to F in which the correction factor for middle drop gradation is set to "1", the waveform pattern used for forming middle drop gradation is set to the waveform pattern "100", which is larger in the amount of ejected ink than the waveform pattern "011". In blocks A and B and blocks H and I in which the correction factor for large drop gradation is set to "0" in the correction factor table, the waveform pattern used for forming large drop gradation is set to the waveform pattern "101" indicating standard in the amount of ejected ink. On the other hand, in blocks C to G in which the correction factor for large drop gradation is set to "1", the waveform pattern used for forming large drop gradation is set to the waveform pattern "110", which is larger in the amount of ejected ink than the waveform pattern "101". In this manner, the difference among the blocks A to I in the amount of ejected ink per nozzle 8 can be made small in each gradation level. Specifically, the difference among the blocks A to I in the amount of ejected ink per nozzle 8 can be made smaller than that without using the correction factor table (table 2) and the selection map (table 3).

The waveform selection section 150 refers to the selection map stored in the map storage section 149 to determine the waveform pattern to be used in response to a print instruction (indicating a block including nozzles 8 requested to eject ink drops and gradation data to be formed) given from the communication section 141. The waveform selection section 150 selects a pulse having the determined waveform pattern from among the pulses generated by the pulse generating sections 144*a* to 144*f*, to supply the selected pulse to corresponding individual electrodes 35 of the actuator unit 21. As a result, the actuator unit 21 is driven to eject corrected ink drops from corresponding nozzles 8, so that a dot with a desired gradation is formed on the sheet of print paper P.

Figure 9:
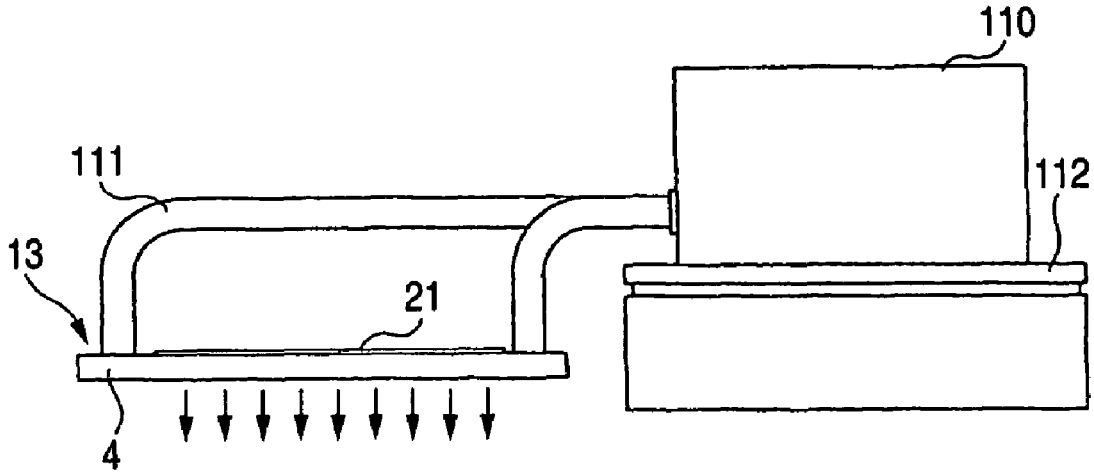
FIG. 9 is a view of system configuration for measuring the amount of ink ejected from nozzles in each of blocks depicted in FIG. 8.

Next, a method for correcting an amount of ejected ink, to be performed after production of the head body 13, will be described. The method for correcting the amount of ejected ink is a method for determining respective correction factors, which are contents of the correction factor table stored in the correction factor storage section 148. First, in each of the blocks A to I, the amount of ink ejected from the nozzles 8 is measured actually (first step). FIG. 9 shows a specific configuration for measuring the amount of ejected ink. As shown in FIG. 9, one end portion of an ink supply pipe 111 is connected to the flow path unit 4 of the produced head body 13. The other end portion of the ink supply pipe 111 is connected to an ink tank 110. As a result, ink reserved in the ink tank 110 is supplied to the flow path unit 4 via the ink supply pipe 111. The actuator units 21 of the head body 13 are connected to a measuring controller (not shown), which can drive the actuator units 21. The ink tank 110 is set on a weighing instrument 112 so that the total weight of the ink tank 110 can be measured.

Figure 10:
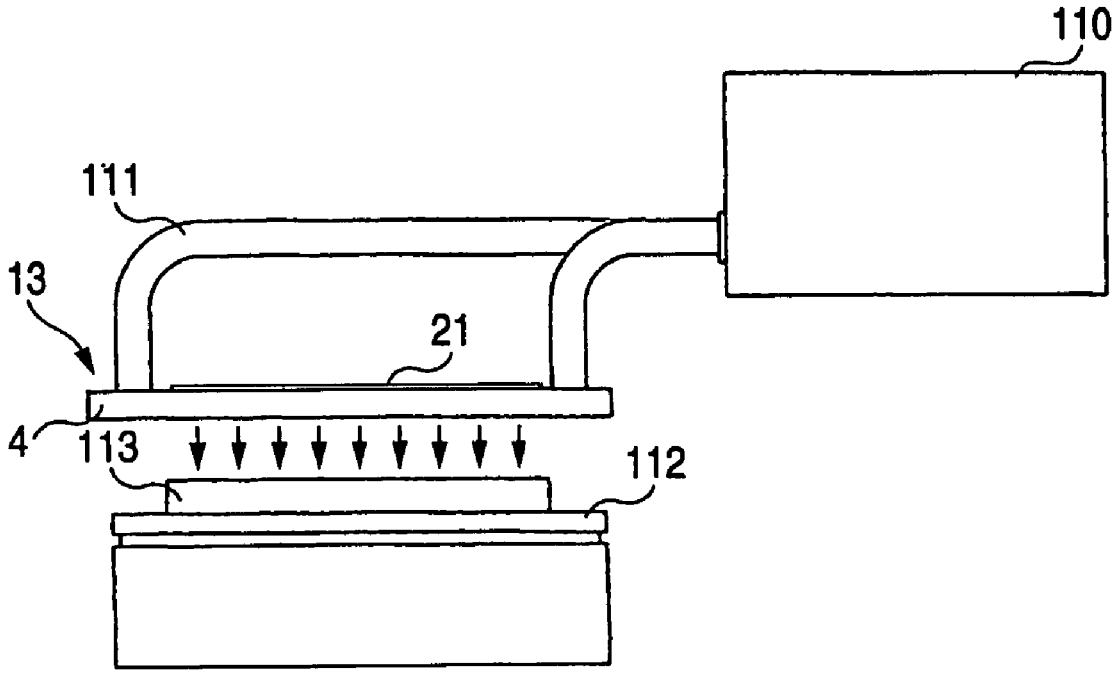
FIG. 10 shows a modified example of system configuration for measuring the amount of ink ejected from nozzles in each of blocks depicted in FIG. 8.

Incidentally, the configuration for measuring the amount of ejected ink from the nozzles 8 is not limited to the aforementioned configuration. For example, as shown in FIG. 10, the weighing instrument 112 may measure the amount of ejected ink while the head body 13 ejects ink drops directly onto a tray 113 set on the weighing instrument 112.

In the aforementioned configuration, the measuring controller drives the actuator unit 21 to eject ink drops from the nozzles 8 of each of the blocks A to I. When the measuring controller ejects ink drops from the nozzles 8 of each of the blocks A to I, the total weight of the ink tank 110 before and after the ink ejection is measured with the weighting instrument 112. As a result, the amount of ink spent (amount of ink reduced) in the ink tank 110 in the ejection of ink drops from the nozzles 8 of each of the blocks A to I can be measured, that is, the amount of ink ejected from the nozzles 8 of each of the blocks A to I can be measured. The amount of ink ejected from the nozzles 8 is measured for each of the blocks A to I and for each of gradation levels (small drop, middle drop and large drop) (amounts of ejected ink corresponding to a plurality of input signal values are measured).

Then, correction factors are determined on the basis of the amount of ink ejected from the nozzles 8 for each of gradation levels and for each of the blocks A to I, as measured by the aforementioned method (second step). Specifically, each measured amount of ejected ink is divided by the number of nozzles 8 in corresponding one of the blocks A to I to thereby calculate the amount of ejected ink per nozzle 8. Correction factors are determined to minimize the difference among the blocks in the amount of ejected ink per nozzle 8. For example, when the calculated amount of ejected ink per nozzle 8 for each of gradation levels in each of the blocks A to I is standard, the correction factor is determined to be "0". On the other hand, when the calculated amount is smaller than the standard amount, the correction factor is determined to be "1". The determined correction factors are stored as a correction factor table in the correction factor storage section 148. On this occasion, a selection map is generated on the basis of the correction factor table and stored in the map storage section 149.

According to the first embodiment described above, because the amount of ejected ink for each of the blocks A to I is measured with the weighing instrument 112, no error occurs due to variation in the surface state of the sheet of print paper P though such error occurs when the density of a printed image is detected. Accordingly, correction factors can be calculated so accurately that density irregularity in a result of printing can be suppressed surely. Moreover, because the weighing instrument 112 is simpler than any optical sensor, correction factors for the amount of ejected ink can be calculated at low cost. Accordingly, the cost of production of the head body 13 can be reduced.

Moreover, because blocks are divided by virtual lines extending in the conveyance direction of the sheet of paper P, variation in the amount of ejected ink with respect to the lengthwise direction of the head body 13 can be restrained from exerting a large bad influence on image quality.

Moreover, because each virtual line passes through a vertex, which is a structural change point in the head body 13 and connects an oblique side of a trapezoidal region defining an actuator unit 21 with a short side of the trapezoidal region, more adequate correction can be made in consideration of the structure of the head body 13.

Moreover, because correction factors can be determined when the step of measuring the amount of ejected ink (first step) is performed once, the measurement of the amount of ejected ink can be executed in a short time. Accordingly, the cost of production of the printer 1 can be reduced.

Moreover, because correction factors are determined for each gradation level, the amount of ejected ink can be corrected accurately in gradation printing.

Moreover, because the amount of ejected ink can be measured by such a simple method that the total weight of the ink tank 110 is measured with the weighing instrument 112, the amount of ejected ink can be measured in a short time.

Moreover, correction factors may be determined so that the amount of ejected ink per nozzle 8 becomes uniform among the blocks A to I. With this configuration, variation in the amount of ejected ink can be suppressed further efficiently.

Also, according to the printer 1 described in the first embodiment, because the amount of ink ejected from the nozzles 8 is corrected by referring to the correction factor table for the blocks A to I stored in the correction factor storage section 148, variation in the amount of ejected ink per nozzle 8 among the blocks A to I can be corrected easily. Accordingly, a high quality image free from density irregularity can be printed while printing throughput can be kept efficient.

According to the first embodiment, the pulse generating sections 144*a* to 144*f* generate the plurality of kinds of waveforms, which are used to eject the different amounts of ink from the nozzles 8, for respective gradation levels. The waveform selection section 150 selects a waveform, which corresponds to a gradation level, for each block from the plurality of kinds of waveforms generated for the respective gradation levels. Therefore, the printer 1 according to this embodiment can print a high quality image in which variation in the amount of ejected ink per nozzle among the blocks is suppressed even in the case of gradation printing.

Also, in the first embodiment, the map storage section 149 stores the correction factor table for each gradation level. Therefore, variation in the amount of ejected ink per nozzle among the blocks can be suppressed easily even in the case of gradation printing.

Moreover, if the contents stored in the correction factor table are changed suitably in accordance with environmental change, variation in the amount of ejected ink per nozzle 8 among the blocks A to I can be suppressed surely.

The change in environment (e.g. temperature) may cause variation of an amount of ink ejected from nozzles 8. Here, a method for correcting an amount of ejected ink according to a modified embodiment in which correction factors for respective environmental conditions are obtained will be described.

In order to obtain the correction factors for the respective environmental conditions, in the production of the head body 13, the step of measuring an amount of ink ejected from nozzles of each block (first step) and a step of obtaining a correction factor for each block and for each gradation level on the basis of the measurement result (second step) are repeated while changing environmental condition. For example, at first temperature is set to 10° C., and then the first step and the second step are performed to obtain correction factors at 10° C. Then, the temperature is changed to 20° C., and then the first step and the second step are performed to obtain correction factors at 20° C. Subsequently, the first and second steps are repeated while changing the temperature by 10° C. up to, for example, 50° C. As a result, the respective correction factors in the range of 10° C. to 50° C. are obtained and stored in correction factor tables, for the respective temperatures, of the map storage section 149.

On the other hand, the printer 1 according to this modification has an environmental sensor such as a temperature sensor or a humidity sensor (not shown). Before the printer 1 performs gradation printing, the waveform selection section 150 selects on the basis of an output of the temperature sensor, one of the correction factor tables for the respective temperatures, stored in the map storage section 149. For example, if an output from the temperature sensor indicates 20° C., the waveform selection section 150 selects the correction factor table for 20° C. stored in the map storage section 149. Then, the waveform selection 150 refers to the selected correction factor table to determine waveform to be used for each block in response to the print instruction given from the communication section 141.

According to this modification, the map storage section 149 stores the correction factor tables for the respective environmental conditions (e.g. temperatures) and the printer 1 includes the environmental sensors (e.g. temperature sensor) Therefore, even if a user moves the printer 1 from one place to another place and the environmental condition around the printer 1 is changed drastically, the printer 1 can address such an environmental change and make difference among blocks in an amount of ink ejected from nozzles be small.

Figure 11:
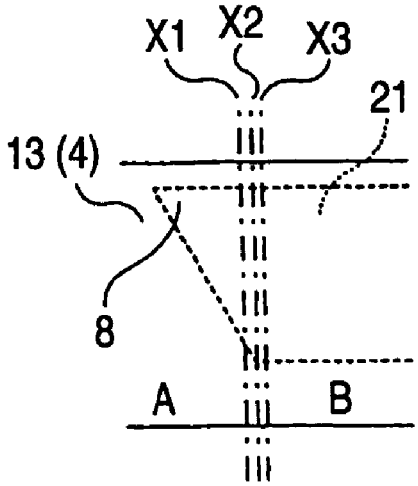
FIG. 11 is a view for explaining a method for correcting an amount of ejected ink according to a second embodiment of the invention.

Next, a method for correcting an amount of ejected ink according to a second embodiment of the invention will be described with reference to FIG. 11. FIG. 11 is a view for explaining the method for correcting the amount of ejected ink according to the second embodiment. Incidentally, the configuration of the printer to which the method for correcting the amount of ejected ink according to the second embodiment is applied is the same as that according to the first embodiment. Like numerals denote like parts for the sake of omission of duplicated description.

The method for correcting the amount of ejected ink is a method for determining respective correction factors, which are contents of the correction factor table stored in the correction factor storage section 148. First, in each of the blocks A to I, the amount of ink ejected from the nozzles 8 is measured (first step). With respect to the configuration and method for measuring the amount of ejected ink, the second embodiment is the same as the first embodiment, so that the description thereof will be omitted.

As shown in FIG. 11, the amount of ejected ink in each of the blocks A to I is measured three times while the position of the virtual line is changed to X1, X2 and X3 successively along the lengthwise direction of the head body 13.

Then, correction factors are determined on the basis of the amount of ejected ink measured by the aforementioned method (second step). First, which of the virtual lines X1 to X3 is adopted as a reference line for calculation of correction factors is determined on the basis of the three amounts of ejected ink measured with the virtual lines X1 to X3 in each of the blocks A to I. Specifically, each amount of ejected ink is divided by the number of nozzles 8 depending on corresponding one of the virtual lines X1 to X3 to thereby calculate the amount of ejected ink per nozzle 8. Then, the calculated amounts of ejected ink per nozzle 8 are arranged in order of the virtual lines X1 to X3. A reference line is determine from among the virtual lines X1 to X3 by comparing absolute values of amounts of change in the amount of ejected ink per nozzle 8 between two adjacent virtual lines. Incidentally, when the amount of change is zero, the virtual line X1 is determined as the reference line. The absolute value of the amount of change between the calculated amount of ejected ink for the virtual line X1 and that for the virtual line X2, and the absolute value of the amount of change between that for the virtual line X2 and that for the virtual line X3 are calculated. If the latter value is larger than the former value, the virtual line X2 is determined as the reference line. If the former value is larger than the latter value, the virtual line X1 is determined as the reference line. With respect to the method for determining correction factors on the basis of the amount of ejected ink, the second embodiment is the same as the first embodiment, so that the description of the method will be omitted.

According to the second embodiment described above, because the most effective block can be determined, the amount of ejected ink can be corrected accurately. Accordingly, density irregularity in a result of printing can be suppressed surely.

Figure 12:
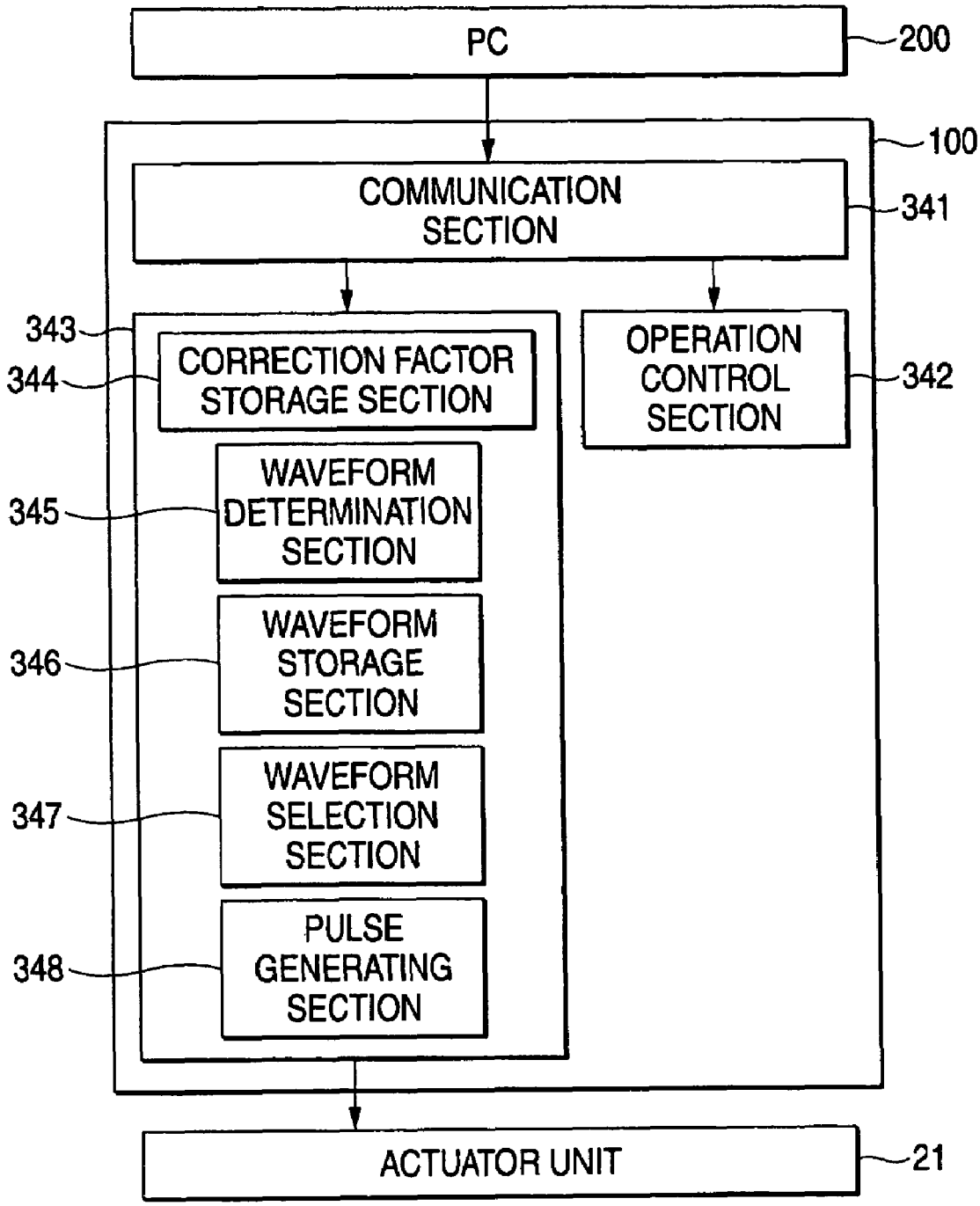
FIG. 12 is a functional block diagram of a controller 100 according to a third embodiment.

Next, a line had inkjet printer according to a third embodiment of the invention will be described with reference to FIGS. 12 to 14. Incidentally, like numerals denote like parts for the sake of omission of duplicated description.

A controller 100 according to the third embodiment will be described in detail with reference to FIG. 12. FIG. 12 is a functional block diagram of the controller 100 according to the third embodiment. The controller 100 includes: a CPU (Central Processing Unit) serving as a processor; an ROM (Read Only Memory) for storing programs executed by the CPU and data used in the programs; an RAM (Random Access Memory) for temporarily storing data at the time of execution of the programs; and a driver IC for driving the actuator units 21. These components work so cooperatively that functional sections described below can work.

The controller 100 operates on the basis of an instruction given from a personal computer (PC) 200. As shown in FIG. 12, the controller 100 functionally includes a communication section 341, an operation control section 342, and a print control section 343. Incidentally, each of the functional sections is implemented by hardware such as an ASIC (Application Specific Integrated Circuit). All of the functional sections may be implemented by software or part of the functional sections may be implemented by software.

The print control section 343 executes printing on the basis of the instruction, which relates to printing and is given from the PC 200. The print control section 343 has a correction factor storage section 344, a waveform determination section 345, a waveform storage section 346, a waveform selection section 347, and a pulse generating section 348.

The correction factor storage section 344 stores a table of correction factors set for each block, which contains at least one nozzle 8 in an ink ejection region of the head body 13. Each correction factor ranks the block in accordance with the amount of ejected ink per nozzle 8 in the block. Each correction factor is determined on the basis of the ratio of the amount of ejected ink per nozzle 8 in each block to an ideal amount of ink ejected from one nozzle 8. Configuration may be made so that the correction factors are determined in such a manner that the amount of ejected ink is measured for each block in the process of production of the head body 13. Alternatively, configuration maybe made so that the correction factors are determined in such a manner that the amount of ejected ink is measured for each block suitably by a sensor provided in the printer 1 for measuring the amount of ejected ink. As will be described later, by correcting the amount of ink ejected from the nozzles 8 for each block on the basis of the correction factors, the difference among blocks in the amount of ejected ink per nozzle 8 can be reduced.

The blocks may be defined as shown in FIG. 8. FIG. 8 is a plan view showing an ink ejection region in the head body 13. A region positionally corresponding to each actuator unit 21 is represented by the broken line. This region defines a pressure chamber group 9 and is shaped like a trapezoid. A large number of nozzles 8 are formed in the region defining the pressure chamber group 9 (see FIGS. 2 and 3). As shown in FIG. 8, the ink ejection region is divided into nine blocks A to I by eight virtual lines extending along the conveyance direction of the sheet of print paper P. Each virtual line passes through a vertex, which connects an oblique side of the trapezoid defining the pressure chamber group 9 with a short side of the trapezoid. That is, the virtual lines are set so that the virtual lines pass through structural change points in the head boy 13 extending along a direction perpendicular to the conveyance direction of the sheet of print paper P. Table 4 shows an example of correction factors corresponding to the blocks A to I depicted in FIG. 8.

TABLE 4

| Block | Correction Factor |
|---|---|
| A | 0 |
| B | 0 |
| C | 0 |
| D | 1 |
| E | 1 |
| F | 1 |
| G | 0 |
| H | 0 |
| I | 0 |

As shown in Table 4, the blocks in the ink ejection region of the head body 13 are ranked by two correction factors "0" and "1". The correction factor "0" indicates that the amount of ejected ink per nozzle 8 is standard. The correction factor "1" indicates that the amount of ejected ink per nozzle 8 is smaller than the standard. Incidentally, the correction factors may be set by an arbitrary number of ranks.

The waveform determination section 345 determines a combination of pulse waveform patterns (waveforms) for each block on the basis of the correction factor table stored in the correction factor storage section 344 so that the difference among the blocks in the amount of ejected ink per nozzle 8 at the time of gradation printing is smaller than that in the case where one and the same combination of pulse waveform patterns (waveforms) corresponding to the respective gradation levels is used for all the blocks. The number n of kinds of waveform patterns to be determined (selected) is larger than the number m of gradation levels in gradation printing. For example, when the number m of gradation levels is 3 (not inclusive of non-ejection of ink), the number n of kinds of waveform patterns is equal to or larger than 4. These waveform patterns are determined so as to eject different amounts of ink from the nozzles.

Figure 13:
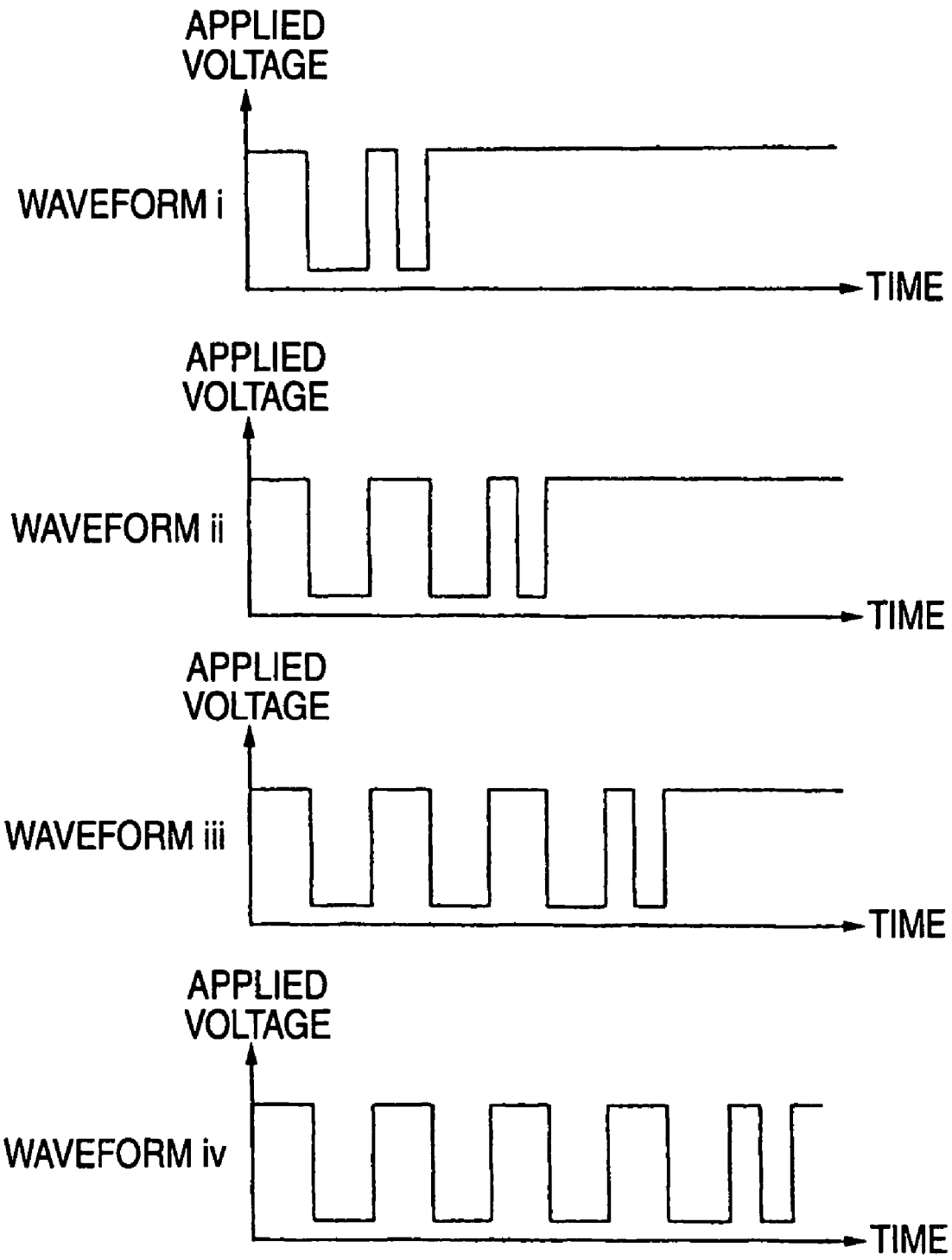
FIG. 13 shows an example of waveform patterns when the number m of gradation levels is 3 and the number n of kinds of waveform patterns is 4.
Figure 14:
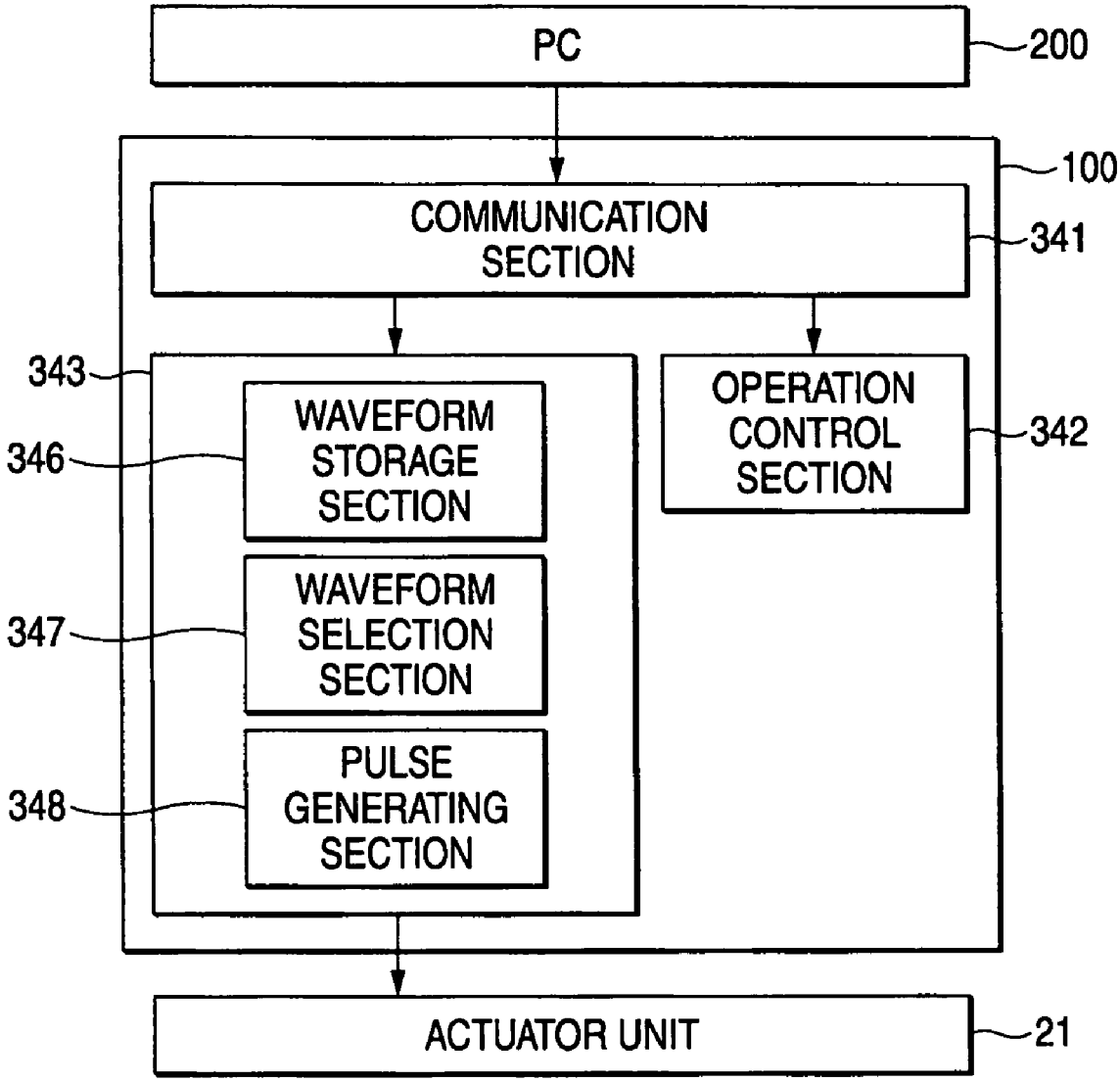
FIG. 14 is a functional block diagram of a controller 100 according to a modified embodiment.

FIG. 13 shows an example of waveform patterns when the number m of gradation levels is 3 and the number n of kinds of waveform patterns is 4. Incidentally, the vertical axis represents a voltage applied to each individual electrode 35, and the horizontal axis represents time. As described above, in the third embodiment, pulses based on high electric potential are supplied to the individual electrode 35 to eject ink drops. As shown in FIG. 13, each of waveform patterns i to iv includes at least one ejection pulse, and a cancel pulse. The ejection pulses are used to eject ink drops from the nozzles 8 so that one pulse can eject one ink drop. The waveform pattern i contains one ejection pulse. The waveform pattern ii contains two ejection pulses. The waveform pattern iii contains three ejection pulses. The waveform pattern iv contains four ejection pulses. That is, the amount of ejected ink increases in order of the waveform patterns i to iv. The cancel pulse is used to remove residual pressure, which remains in the individual ink flow path 32 after ink is ejected. The cancel pulse generates new pressure in the individual ink flow path 32 at timing of a period inverted to the period of residual pressure. As a result, the residual pressure is canceled with pressure generated by the cancel pulse. As shown in Table 5, 3-bit codes (001 to 100) for specifying the waveform patterns are added to the waveform patterns i to iv, respectively.

TABLE 5

| Waveform Pattern | Code |
|---|---|
| i | 001 |
| ii | 010 |
| iii | 011 |
| iv | 100 |

The waveform storage section 346 stores for each block a combination of waveform patterns determined by the waveform determination section 345. Table 6 shows combinations of waveform patterns determined by the waveform determination section 345 on the basis of data in Tables 4 and 5. Incidentally, three kinds of gradation data used in gradation printing are represented by small drop, middle drop and large drop indicating the size of an ink drop landed on the sheet of print paper P.

TABLE 6

| Block | Small Drop | Middle Drop | Large Drop |
|---|---|---|---|
| A | 001 | 010 | 011 |
| B | 001 | 010 | 011 |
| C | 001 | 010 | 011 |
| D | 010 | 011 | 100 |
| E | 010 | 011 | 100 |
| F | 010 | 011 | 100 |
| G | 001 | 010 | 011 |
| H | 001 | 010 | 011 |
| I | 001 | 010 | 011 |

As shown in Table 6, in blocks A to C and blocks G to I in which the amount of ejected ink per nozzle 8 is standard (correction factor "0": see Table 4), the waveform patterns i to iii are assigned to the small, middle and large drops successively. In blocks D to F in which the amount of ejected ink per nozzle 8 is small (correction factor "1": see Table 4), the waveform patterns ii to iv are assigned to the small, middle and large drops successively in order to increase the amount of ejected ink per nozzle 8. Accordingly, in the blocks A to I, the difference in the amount of ejected ink per nozzle 8 can be reduced in comparison with the case where the same combination of waveform patterns i to iii or ii to iv for respective gradation levels is used for all the blocks A to I.

The waveform selection section 347 selects a waveform pattern (waveform) for each of the blocks A to I from the combinations of waveform patterns stored in the waveform storage section 346 for each of the blocks A to I on the basis of gradation data (small drop, middle drop and large drop) of a dot to be landed on the sheet of print paper P. Then, the waveform selection section 347 makes the pulse generating section 348 generate pulses having the selected waveform pattern, and supplies the generated pulse to corresponding one of the individual electrodes 35 of the actuator 21. As a result, the actuator unit 21 is driven to eject ink drops from a corresponding nozzle 8 in accordance with the waveform patterns, so that a dot with a desired gradation is formed on the sheet of print paper P.

The pulse generating section 348 generates pulses having any one of waveform patterns i to iv selected by the waveform selection section 347. The generated pulses are supplied to corresponding one of the individual electrodes 35 of the actuator 21 by the waveform selection section 347.

According to the third embodiment described above, because the amount of ink ejected from the nozzles 8 is corrected for each of the blocks A to I by changing the combination of waveform patterns i to iv for each of the blocks A to I, variation in the amount of ejected ink per nozzle 8 among the blocks A to I at the time of gradation printing can be corrected easily. Accordingly, a high quality image free from density irregularity can be printed while printing throughput can be kept efficient.

Moreover, if the correction factors stored in the correction factor storage section 344 are changed suitably in accordance with environmental change, variation in the amount of ejected ink per nozzle 8 among the blocks A to I can be suppressed surely.

Moreover, because blocks are divided by virtual lines extending along the conveyance direction of the sheet of paper P, variation in the amount of ejected ink with respect to the lengthwise direction of the head body 13 can be restrained from exerting a large bad influence on image quality.

In addition, each virtual line passes through a vertex, which is a structural change point in the head body 13 and connects an oblique line of a trapezoidal region defining an actuator unit 21 with a short side of the trapezoidal region. Therefore, more adequate correction can be made in consideration of the structure of the head body 13.

Next, a modified example of the third embodiment will be described with reference to FIG. 14. In the third embodiment, the print control section 343 of the controller 100 has the correction factor storage section 344 and the waveform determination section 345 so that the waveform determination section 345 determines contents to be stored in the waveform storage section 346 on the basis of contents stored in the correction factor storage section 344. However, the invention is not limited to this configuration of the third embodiment. As shown in FIG. 14, the controller 100 may be configured so that predetermined contents are stored in the waveform storage section 346, without including the correction factor storage section 344 and the waveform determination section 345.

Although preferred embodiments of the invention have been described, the invention is not limited to the aforementioned embodiments. Various design changes may be made without departing from the scope of claim appended below and claims hereinafter introduced. For example, the virtual line may be set (defined) so as to extend in any arbitrary direction although the aforementioned embodiments have been described on the case where the virtual line extends in a direction perpendicular to the conveyance direction of the sheet of print paper P. Each virtual line may be formed of a plurality of straight lines (that is, each virtual line may be a polygonal line) or contain a curve although the aforementioned embodiments have been described on the case where each virtual line is formed of a singe straight line.

Although the aforementioned embodiments have been described on the case where the virtual lines pass through structural change points in the head body 13, the invention is not limited to this configuration. The virtual lines may not pass through the structural change points in the head body 13. In this case, it is preferable that the virtual lines are arranged on the basis of the distance between the virtual lines in a direction perpendicular to the conveyance direction of the sheet of print paper P.

In the aforementioned embodiments, each of the blocks A to I includes a plurality of nozzles 8. However, a block including only one nozzle 8 may be set.

In the first and second embodiments, the amount of ejected ink is measured with the weighing instrument 112. Instead, the volume of a ejected ink drop may be measured.

In the embodiments, the number m of gradation levels is 3 and the number n of kinds of waveform patterns is 4. However, the invention is not limited to this specific configuration. The number m of gradation levels and the number n of kinds of waveform patterns may be selected arbitrarily so long as the number n of kinds of waveform patterns is equal to or larger than 3 and the number m of gradation levels is equal to or larger than 2 and smaller than the number n of kinds of waveform patterns. For example, the number m of gradation levels may be 4 and the number n of kinds of waveform patterns may be 6. Alternatively, the number m of gradation levels may be 3 and the number n of kinds of waveform patterns may be 5. In this case, the number of ranks based on correction factors for ranking the amount of ejected ink may be set to be 3.

What is claimed is:

1. A method for correcting an amount of ejected ink in a line head inkjet printer including an inkjet head having a plurality of nozzles, which are divided into blocks including at least one nozzle, a flow path unit in which the plurality of nozzles are formed, and a plurality of actuator units having a trapezoidal shape, the actuator units being arranged on the flow paths unit so that oblique sides of adjacent actuator units overlap each other when viewed in a conveyance direction, the method composing:

measuring the amount of ink ejected from each of n of the blocks divided by n−1 virtual lines extending in the conveyance direction of a printing medium where n represents a natural number equal to or greater than 2, wherein the virtual lines each pass through a corresponding one of a plurality of structural change points in the inkjet head, each structural change point corresponding to a point where an oblique side of one of the actuator units intersects with a short side of the one of the actuator units, the structural change points extending in a direction perpendicular to the conveyance direction; and obtaining a correction factor for each block on a basis of the measured amount of ejected ink in each block, the correction factors making a difference among the blocks in an amount of ejected ink per nozzle becoming smaller than that without using the obtained correction factors.

2. The method according to claim 1, wherein:

the n blocks are arranged along a lengthwise direction of the flow path unit.

3. The method according to claim 1, wherein the measuring is conducted only once.

4. The method according to claim 1, wherein at least one of the blocks includes a whole boundary area between two adjacent actuator units.

5. The method according to claim 1, wherein:

the measuring comprises inputting an input signal to eject ink; and the measuring and the obtaining are repeated plural times with using different input signals, to obtain the correction factors for the respective input signals.

6. The method according to claim 5, wherein the plurality of input signals correspond to a plurality of gradation signals indicating gradation levels different from each other.

7. The method according to claim 1, wherein the measuring comprises measuring for every block, an amount of ink decreased in an ink tank connected to the inkjet head when ink is ejected only from nozzles included in each block.

8. The method according to claim 1, wherein the obtaining comprises obtaining the correction factors, which make the amounts of ejected ink per nozzle in the blocks equal to each other.

9. The method according to claim 1, further comprising:

obtaining a waveform to be used to make the nozzles eject ink, on a basis of the obtained correction factor for each block.

* * * * *